United States Patent [19]

Field

[11] Patent Number: 4,580,385

[45] Date of Patent: Apr. 8, 1986

[54] WALL PANEL CLIP

[76] Inventor: Frank P. Field, 854 Napoli Dr., Pacific Palisades, Calif. 90272

[21] Appl. No.: 736,836

[22] Filed: May 22, 1985

Related U.S. Application Data

[63] Continuation of Ser. No. 599,194, Apr. 11, 1984.

[51] Int. Cl.[4] ..... E04C 1/10

[52] U.S. Cl. ..... 52/578; 52/586; 52/762; 52/764; 52/772; 52/775

[58] Field of Search ..... 52/36, 464, 463, 460, 52/762, 764, 772, 775, 281, 586; 248/14, 15, 243, 224.1, 224.3, 225.1; 211/90, 103, 182, 190, 191, 208

[56] References Cited

U.S. PATENT DOCUMENTS

| | | | |
|---|---|---|---|
| 1,171,346 | 2/1916 | Rose | 52/36 |
| 1,235,679 | 8/1917 | Gerberich | 211/90 X |
| 2,821,274 | 1/1958 | Olsen | 52/463 X |
| 3,073,420 | 1/1963 | Olsen | 52/586 |
| 3,265,217 | 8/1966 | Biggs | 211/90 |
| 3,269,553 | 8/1966 | Ruhnke | 211/103 |
| 4,048,768 | 9/1977 | Good | 52/36 |

*Primary Examiner*—Carl D. Friedman
*Assistant Examiner*—Creighton Smith
*Attorney, Agent, or Firm*—Hubbard, Stetina & Brunda

[57] ABSTRACT

An improved wall panel clip includes a retainer plate and a hook member extending from the retainer plate for insertion into a slot to retain a wall panel against an upright. The hook forms a notch having a narrow opening and a wider inner width. The surface of the hook adjacent the narrow opening engages a surface of the upright when the hook is positioned in the slots so that a portion of the upright penetrates into the slot. Engagement of the hook with the surface of the upright resists inadvertent movement of the clip relative to the upright to retain the panel in position on the upright. The clip preferably includes a plurality of such hooks projecting from a spacer plate that extends from the retainer plate. The width of the spacer plate is preferably approximately equal to the thickness of a panel to be installed upon the upright so that when the hooks are engaged in the slots, an outer edge of the spacer plate is engaged with a surface of the upright so that the hooks and edge of the spacer plate cooperate to firmly engage the clip upon the upright while the retainer plate retains the panel adjacent the upright.

6 Claims, 6 Drawing Figures

Fig. 1
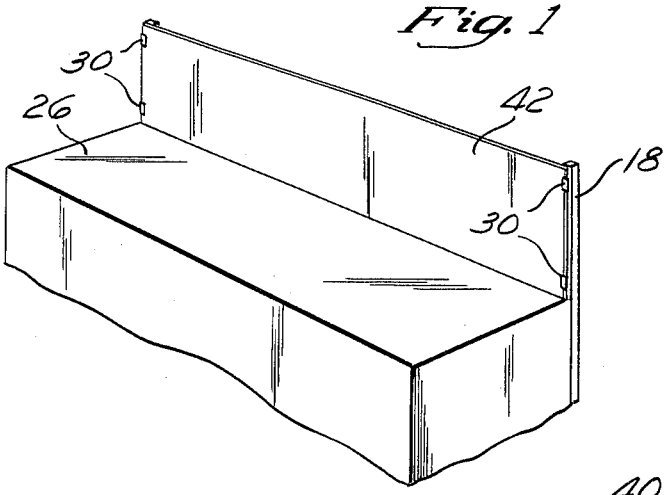
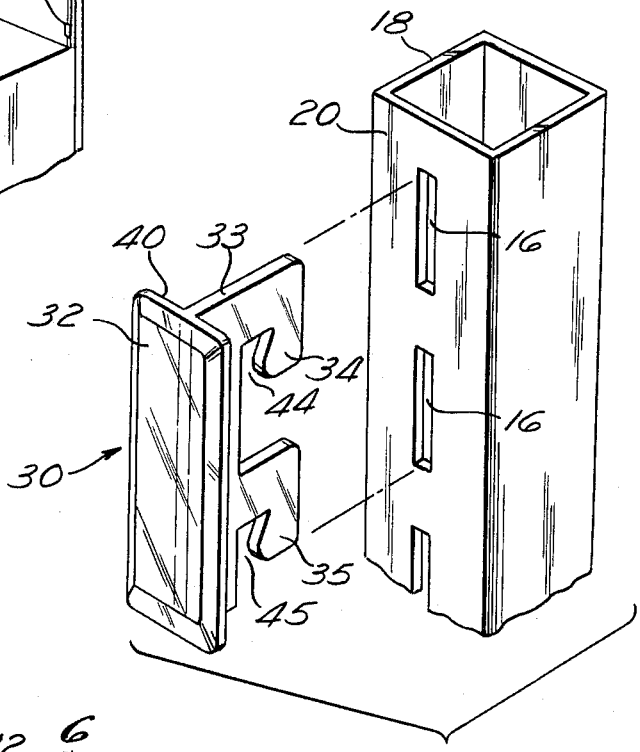
Fig. 2
Fig. 3
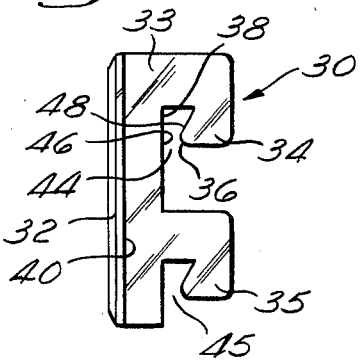
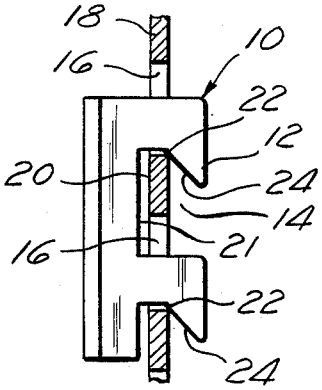
Fig. 4
(PRIOR ART)
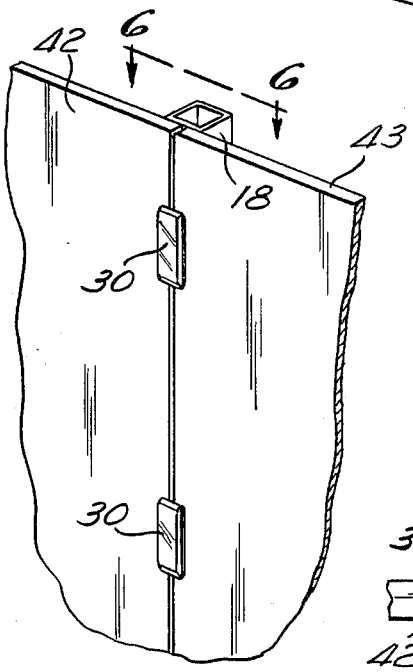
Fig. 5
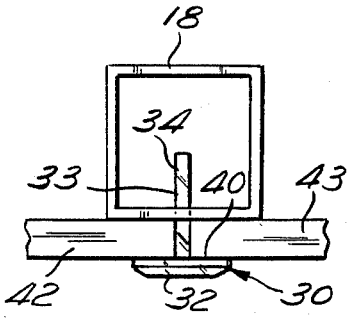
Fig. 6

WALL PANEL CLIP

This application is a continuation of application Ser. No. 599,194, filed Apr. 11, 1984.

BACKGROUND OF THE INVENTION

The present invention relates generally to an improved wall panel clip to be placed in slotted vertical uprights to secure a removable panel to the upright and more particularly to an improved wall panel clip which resists unintended loosening or removal from the slotted vertical upright during use.

The use of temporary partitions, display structures and the like in merchandising display applications is increasing because of the economy and versatility of being able to quickly remove a partition or structure to serve a particular temporary purpose and to disassemble the structure for storage or use for another purpose. Typically, these wall partitions are assembled from various sized structural members to which a variety of different sized panels may be attached to serve as full wall partitions or single dividers in a smaller structure. The structural members include slotted uprights of a general square hollow configuration. A plurality of small rectangular slots extend vertically along one or more of the surfaces of the uprights. The slots are designed to receive various mounting members to support display bins or the like and small clips that serve to hold a panel against the upright. The size of the panels may range from small partitions to complete walls. The panels may be manufactured from a variety of materials including plastic, metal or wood.

Of the numerous types of prior art clips available, a common disadvantage is their tendency to continuously loosen during use, particularly when the panels are subjected to external forces, pressures, or vibrations typically encountered in retail merchandising aplications that necessarily cause movement of the panel. The larger or heavier the panels are, the more quickly the clips loosen, thereby disrupting the utility of the panel and requiring frequent replacement of the panel clips. Prior art panel clip devices typically have notches of a constant width, or the notches are widest at the opening thereof, which causes the clip to loosen in response to panel movement.

Therefore, there exists a substantial need in the merchandising display art for a wall panel clip that is inexpensive and that will reliably secure different sized panels to uprights without loosening as the panel is subjected to external pressures or vibrations caused by continuous interaction of consumer shoppers.

SUMMARY OF THE INVENTION

The present invention specifically addresses and alleviates the above-referenced deficiencies associated in the art and comprises a wall panel clip used to secure removable wall panels or partitions to a basic slotted upright structure. More particularly, the invention relates to a small inexpensive wall panel clip that firmly secures a wall panel against an upright structural member, with the clip providing a self-tightening feature in response to encountering pressures or forces that are exerted on the panels; i.e., pressures and forces typically encountered in retail merchandise applications which heretofore have normally cause a loosening of prior art clip devices.

The panel clip of the present invention comprises a small rectangular retainer plate from which two generally L-shaped hook members extend in a perpendicular orientation. The rectangular plate serves to hold the panel in position by squeezing or pressing the edge of the panel tightly against the slotted upright when the panel clip is in place. The retainer plate is sized to extend over the edge of the panel sufficiently to achieve a constant and secure registration of the plate against the panel. Additionally, the retainer plate is sized to provide proper registry of two adjacent panels installed on either side of the upright.

The novel hook members are positioned adjacent either end of the plate and extend outwardly in a perpendicular orientation to the plane of the retainer plate. The hook members project from a generally rectangular portion that extends lengthwise along the center of outside of the plate. The width of the rectangular portion is substantially the same as the thickness of the wall panel to be used with the panel clip.

The hook members each include a smaller curved portion sized to be received by the slots in the upright structure and are formed with a unique notch adapted to firmly engage the upright. The notch is a space between the rectangular portion and a curved portion of the hook member. The width of the notch proximate the open end thereof is substantially the same as or slightly smaller than the thickness of the side of the upright. The notch is formed with one side being the edge of the rectangular portion and parallel to the plane of the plate; and the opposing side of the notch is curved such that the width of the notch progressively widens inwardly from the opening. The novel design notch imparts a self-locking characteristic to the wall clip that advantageously maintains the clip in a tightly locked position in a slot.

Use of the panel clip of the present invention entails positioning a panel parallel to the structural upright with the edge of the panel extending over the upright and adjacent the vertical slots. The hook members of the panel clip are inserted in the slots of the upright; and the panel clip is moved lengthwise relative to the upright to engage the innermost edges of the hook members against the edges of the slots. When the clip is installed in the slots, the curved portions of the hook members proximate the notch openings forcibly engage portions of the inner wall of the upright near the slots. Because of the novel angle in the notch, any movement of the panel lengthwise along the upright causes the clip to self-tighten on the panel and the structural upright, thereby resisting further panel movement.

BRIEF DESCRIPTION OF THE DRAWINGS

These as well as other features of the present invention will become more apparent upon reference to the drawings, wherein:

FIG. 1 is a perspective view of a counter top having a wall extending therefrom assembled with the clip of the present invention;

FIG. 2 is an exploded perspective view of the clip of FIG. 1;

FIG. 3 is a side elevation view of the clip of FIG. 1;

FIG. 4 is a side elevation view of a typical prior art panel clip and includes a partial cross-sectional view of an upright having slots engaged with the prior art panel clip;

FIG. 5 is a perspective view of two abutting panels connected to an upright with the clip of FIGS. 1, 2 and 3; and FIG. 6 is a top plan view of the panels, upright, and clip of FIG. 5.

DESCRIPTION OF THE PREFERRED EMBODIMENT

The advantages of the present invention may be more fully appreciated by first explaining the structure and deficiencies of a typical prior art wall fastening device.

Referring to FIG. 4, there is shown a side view of a prior art wall fastening device 10 including a hook 12 formed to have a V-shaped notch 14. The hook 12 is sized to be inserted into a slot 16 of an upright member 18, best shown in FIG. 2, and moved in a generally downward direction to engage an edge of the slot 16 in the upright member 18 in the V-shaped notch 14. The upright member 18 has an outside surface 21 positioned to face an inside edge 21 of the V-shaped notch 14 while the inside edge of the slot 16 rests on an outside edge 24 of the notch 14. As can be appreciated by those skilled in the art, the outside edge 24 acts as a camming surface with respect to the edge 22 of the slot 16 in response to any movement of the wall fastening device 10, thereby forcing the wall fastening device 10 in an upward direction as viewed in FIG. 4 causing the fastening device 10 to loosen.

Referring generally to FIGS. 1–3 and 5–6, there is shown an improved panel clip 30 according to the present invention. FIG. 1 shows a plurality of clips 30 used to mount a panel 42 above a counter 26.

In the preferred embodiment, the panel clip 30 is constructed as a single unit formed of high-strength polycarbonate by an injection-molded process, although other materials and methods of construction and manufacture are included in the present invention. The panel clip 30 comprises a rectangular retaining plate 32, a generally rectangular spacer plate 33 and a pair of hook members 34 and 35. The spacer plate 33 is preferably generally rectangular and preferably extends the length of the retaining plate 32. The spacer plate 33 is preferably centrally located on one side of the retainer plate and extends generally perpendicularly therefrom. The hook members 34 and 35 extend outwardly from the spacer plate 33 in a plane perpendicular to the plane of the retaining plate 32.

The retaining plate 32 is formed with a flat registry surface 40, best shown in FIG. 6, adapted to extend over and abut a peripheral outside surface of a wall panel 42 as illustrated in FIG. 5. Two such wall panels 42 and 43 oriented in the same plane may be secured by the retaining plate 32.

Since both hook members 34 and 35 have substantially identical structures, only the hook member 34 is described in detail herein. The hook member 34 has a curved portion 36 and an elongate rectangular portion 38. The hook extension 34 is formed with a notch 44 having a width at the opening of the notch 44 equal to or slightly less than the thickness of the upright 18. The notch 44 has a proximal edge 46 which is an edge of the rectangular spacer plate 33, and the notch has a distal edge 48 formed at an angle to the proximal edge 46 such that the notch 44 progressively widens from the opening into the notch 44. The edge of the spacer plate 33 forms a common portion 38 of the notch 44 and of a notch 45 in the hook member 35. The width of the spacer plates 33 is substantially the same as the thickness of the panel 42 with which the panel clip 30 is to be used.

Referring to FIGS. 2, 5 and 6, the improved panel clip 30 is used by positioning one or two wall panels 42, 43 against the upright 18 with the hook members 34 and 35 being aligned with adjacent slots 16. While the wall panels 42, 43 are held in position, the hook extensions 34, 35 of the panel clip 30 are inserted in the slots 16 of the upright 18; and the panel clip 30 is moved in a generally downwardly direction. This movement of the clip 30 forces a portion of the upright 18 into the notches 44, 45 thereby engaging the panel clip 30 with the upright 18 and securing the panels 42, 43 between the upright 18 and the retaining plate 32 of the panel clip 30. As can be appreciated by those skilled in the art, any movement of the panel 42 would cause the clip 30 to tighten upon the panel in response to such movement.

Thus, the present invention provides a significantly improved a wall panel clip 30 that corporates a novel design and provides a self-locking characteristic in response to movements of the wall panel 42. Those skilled in the art will recognize that the present invention may be readily adapted to accommodate a variety of different thickness and weight wall panels 42 and may include other retaining plate designs and methods of construction without departing from the spirit of the present invention.

What is claimed is:

1. A wall panel clip device for securing a panel to an upright having a plurality of vertically spaced slots therein, comprising:

a retaining plate; and a generally L-shaped hooked member, integrally formed with said retaining plate and sized to be inserted into said slots of said upright, said hook member having a first leg portion extending generally perpendicularly outward from said plate and a second leg portion extending generally perpendicularly downward from said first leg portion, said second leg portion having an engagement surface extending angularly upward and divergent from said plate to terminate at said first leg portion, said engagement surface forming a self-tightening fit between said second leg portion and the vertical upright, said fit resisting movement of the clip relative the upright when said hook member is engaged in one of said slots on said upright to retain said hook member against unintentional removal from said slot, said retaining plate being formed to extend over a portion of said panel and urge said panel against said upright when said hook member is engaged in one of said slots.

2. The wall panel clip of claim 1 further comprising a plurality of said hook members.

3. The wall panel clip of claim 1 wherein said notch further includes a first side and a second side, said first side being generally parallel to the longitudinal axis of said upright, said second side being angled with respect to said first side to vary the width of said notch, said width being narrowest at the opening of said notch to permit self-tightening of said wall panel clip on said upright in response to movement of said panel.

4. The wall panel clip of claim 1 further comprising a spacer plate between said retaining plate and said hook member, said spacer plate extending from said retaining plate a distance corresponding to the thickness of said wall panel.

5. A wall panel clip device for securing a panel to an upright having a plurality of vertically spaced slots therein, comprising:

a retaining plate; and a generally L-shaped hooked member integrally formed with said retaining plate and sized to be inserted into said slots of said upright, said hook member having a first leg portion extending outward and perpendicular from said plate and a second leg portion, said second leg portion having an engagement surface extending angularly downward from said first leg portion and inward to engage with said upright, said engagement surface forming a self-tightening fit between said second leg and said smooth upright, said first resisting movement of the clip relative the upright when said hook member is engaged in one of said slots on said upright, said retaining plate being formed to extend over a portion of said panel and urge said panel against said upright when said hook member is engaged in one of said slots.

6. The wall panel clip device of claim 5 wherein said engagement surface is formed in a generally smooth and curvilinear configuration.

* * * * *